US010590500B2

(12) United States Patent
Baettenhausen et al.

(10) Patent No.: US 10,590,500 B2
(45) Date of Patent: Mar. 17, 2020

(54) APPARATUS FOR THE PRESS HARDENING OF COMPONENTS

(71) Applicant: N. Baettenhauses Industrielle Waerme—und Elektrotechnik GmbH, Wetzlar-Naunheim (DE)

(72) Inventors: Norbert Baettenhausen, Wetzlar (DE); Walter Hoegler, Wetzlar (DE)

(73) Assignee: N. Bättenhausen Industrielle Wärme- und Elektrotechnik GmbH, Wetzlar-Naunheim (DE)

( * ) Notice: Subject to any disclaimer, the term of this patent is extended or adjusted under 35 U.S.C. 154(b) by 1063 days.

(21) Appl. No.: 14/785,876

(22) PCT Filed: Apr. 11, 2014

(86) PCT No.: PCT/EP2014/057359
§ 371 (c)(1),
(2) Date: Oct. 21, 2015

(87) PCT Pub. No.: WO2014/173703
PCT Pub. Date: Oct. 30, 2014

(65) Prior Publication Data

US 2016/0076116 A1 Mar. 17, 2016

(30) Foreign Application Priority Data

Apr. 25, 2013 (DE) ..... 10 2013 104 229

(51) Int. Cl.
*C21D 1/18* (2006.01)
*F27B 9/20* (2006.01)
(Continued)

(52) U.S. Cl.
CPC ..... *C21D 1/18* (2013.01); *C21D 9/0018* (2013.01); *C21D 9/0056* (2013.01); *F27B 9/20* (2013.01);
(Continued)

(58) Field of Classification Search
CPC ..... B21D 22/208; C21D 1/18; C21D 1/673; C21D 9/0018; C21D 9/0056; C21D 9/48;
(Continued)

(56) References Cited

U.S. PATENT DOCUMENTS

2009/0127753 A1* 5/2009 Vehof ..... F27B 9/20 266/44
2011/0214786 A1* 9/2011 Loecker ..... C21D 1/673 148/559
(Continued)

FOREIGN PATENT DOCUMENTS

DE 10 2006 054389 5/2008
DE 10 2009 050879 9/2011
(Continued)

*Primary Examiner* — Veronica F Faison
(74) *Attorney, Agent, or Firm* — Clark & Brody

(57) ABSTRACT

The invention relates to an apparatus and to a method for the press hardening of components (2), having at least one furnace (3), having a press (8), which is arranged downstream of the at least one furnace (3), and having a transporting apparatus (4).

In order to provide for cycle times which are as short as possible, means (5) for transporting the components (2) are mounted in a moveable manner in the transporting apparatus (4), wherein the means (5) with the components (2) can be moved, along the transporting apparatus (4), through the furnace (3) and into the press (8), wherein the transporting apparatus (4) is continuous between the furnace (3) and the press (8), and wherein the components (2) can be transported from the furnace (3) to the press (8) without being manipulated.

11 Claims, 3 Drawing Sheets

(51) Int. Cl.

| | |
|---|---|
| ***F27B 9/24*** | (2006.01) |
| ***C21D 9/00*** | (2006.01) |
| ***F27D 3/12*** | (2006.01) |
| ***F27D 3/00*** | (2006.01) |
| ***F27B 9/28*** | (2006.01) |
| *C21D 9/48* | (2006.01) |
| *B21D 22/02* | (2006.01) |
| *B21D 22/20* | (2006.01) |
| *C21D 1/673* | (2006.01) |

(52) U.S. Cl.
CPC ..... *F27B 9/24* (2013.01); *F27B 9/2461* (2013.01); *F27B 9/28* (2013.01); *F27D 3/0024* (2013.01); *F27D 3/12* (2013.01); *B21D 22/022* (2013.01); *B21D 22/208* (2013.01); *C21D 1/673* (2013.01); *C21D 9/48* (2013.01); *F27D 2003/0069* (2013.01)

(58) Field of Classification Search
CPC .. F27B 9/20; F27B 9/24; F27B 9/2461; F27B 9/28; F27D 2003/0069; F27D 3/0024; F27D 3/12
See application file for complete search history.

(56) References Cited

U.S. PATENT DOCUMENTS

2015/0298199 A1* 10/2015 Pellmann ..... C21D 1/52 148/531
2016/0108489 A1* 4/2016 Sikora ..... C21D 9/0018 219/654

FOREIGN PATENT DOCUMENTS

| | | |
|---|---|---|
| DE | 10 2012 218 159 | 4/2014 |
| EP | 2 110 448 | 10/2009 |
| WO | 2014/053550 | 4/2014 |

* cited by examiner

APPARATUS FOR THE PRESS HARDENING OF COMPONENTS

FIELD OF THE INVENTION

Press hardening, also referred to as hot stamping, is a method for deforming components, in particular sheet-metal materials, by heat. It comprises a combination of heat treatment, shaping and, possibly, controlled cooling.

BACKGROUND OF THE INVENTION

Press hardening is often used, inter alia, in automotive production, for example in conjunction with lightweight automotive concepts. It is often used there for deforming coated metallic components so that, on the one hand, the components do not undergo scaling during the heat treatment and, on the other hand, the durability of the tools is increased and corrosion protection for during subsequent use is ensured.

The components fed for press hardening are coated, for example, with an aluminum/silicon alloy. In the case of customary apparatuses, using such coatings often results, during the heat treatment in the furnace, in individual components of the furnace being adversely affected in thermochemical terms. Particularly affected here are parts of a transporting apparatus serving for conveying the components through the furnace and thus coming into direct contact with the components. This results in high costs for maintenance and servicing.

If the components which are to be deformed have a contact-sensitive coating, for example a zinc coating, contact for example with the transporting apparatus of the furnace may result in the coating being damaged. Contact of a zinc coating with some other, for example rough, surface, e.g. with rollers of a roller hearth furnace or with shelves of a chamber furnace, can be damaged as a result of the friction occurring here.

In the case of the known press-hardening methods, the components first of all are heated in the furnace to a temperature of, for example, approximately 950° C. and then are transported into a press. There, controlled cooling usually takes place during the shaping operation in the press. The furnace is designed usually in the form of a roller hearth furnace or of a chamber furnace, wherein, in the case of roller hearth furnaces, the components are guided through the furnace via a roller track and, in the case of a chamber furnace, the components are placed in the furnace by a manipulator. Other types of furnace, for example walking beam furnaces and chain furnaces, have not become generally accepted.

In order for the components to pass into the press with the lowest possible temperature loss, the components should be transferred as quickly as possible from the furnace into the press. This is carried out usually with the aid of a manipulator, such as a robot, which removes the components directly from the furnace or grips the components guided out through the furnace by a transporting apparatus, for example, the aforementioned roller track, and transfers said components into the press. The manipulator then also serves to move the component, prior to introduction into the press, into the correct position for example by rotation.

Both transportation between the furnace and press and the execution of the manipulations involve an amount of time which, for process-related reasons, is difficult to reduce, and, as a result, even before the shaping process has begun, the component cools or, in the case of uncoated components, is additionally subjected to scaling. Accordingly, the components have to be brought to a higher temperature in the furnace than would actually be necessary for the following shaping process in the press. This adversely affects the energy efficiency of the method. Furthermore, the operation of the components being transferred by the manipulator increases the risk of the coating being damaged by mechanical contact.

In the case of the known methods, therefore, a high degree of automation is necessary. The necessary manipulations mean that it is possible here not just for the coating to be damaged; rather, it is also the case that it is barely possible to reduce the cycle times, as is advantageous for efficient operation.

It is therefore an object of the invention to eliminate this disadvantage, and further disadvantages, of the prior art and to provide an apparatus for the press hardening of components which allows rapid, non-destructive, energy-efficient and cost-effective processing of the components. In particular the intention is to rule out as far as possible thermochemical attack of the coating of the components on means of a transporting apparatus and to avoid as far as possible the situation where the coating is damaged by contact. The components here should be transferred from the furnace into the press as quickly as possible, so that unnecessary cooling is prevented. It is also intended to provide a method for the press hardening of components using an apparatus according to the invention.

Configurations of the invention form the subject matter of claims 2 to 11.

SUMMARY OF THE INVENTION

In the case of an apparatus for the press hardening of components, having at least one furnace, having a press, which is arranged downstream of the furnace, and having a transporting apparatus, the invention provides for means for transporting the components to be mounted in a displaceable manner in the transporting apparatus, wherein the means with the components can be moved, along the transporting apparatus, through the furnace and into the press, wherein the transporting apparatus is continuous between the furnace and the press, and wherein the components can be transported from the furnace to the press without being manipulated.

The invention thus makes provision for the same means to be used not just for moving the components into the furnace, but also for guiding them through the furnace and displacing them into the press. There is therefore no need for any additional manipulators for transferring the components between the furnace and press. Accordingly, it is not only the case that production outlay for the apparatus is reduced; in addition, possible cycle times are reduced, since the components can be transported more quickly from the furnace to the press. It is possible here for the means to come into contact with the components in regions which either do not have any coating or are located outside a later useful region of the component. These regions can be removed, for example, in the press or following the pressing operation. The useful region of the components is thus guided contactlessly through the furnace and into the press, and therefore even contact-sensitive coatings can be readily processed.

It is possible here for the transporting apparatus to have portions running at different transporting speeds. For example, a lower transporting speed is desired for guiding the means with the components through the furnace than, for example, for transporting the components from the furnace into the press. This can be achieved, for example, using appropriate mechanisms.

In order to increase productivity, it is possible for a plurality of furnaces to be used parallel to one another, said furnaces charging a common press. Advantage is taken here of the fact that the heating process in the furnace usually requires considerably more time than the downstream pressing operation.

It is preferably the case that the transporting apparatus is continuous from a loading station upstream of the furnace, as seen in the movement direction, at least into a pressing position in the press. This constitutes a relatively straightforward configuration for guiding the components, without manipulation, not just into the furnace, but also from the furnace into the press.

In a preferred configuration, the press is designed in the form of a press with a horizontal pressing direction. There is then no need for rotation or pivoting of the components, which are usually guided vertically through the furnace. Accordingly, short cycle times can be realized.

The transporting apparatus may be guided outside the furnace and/or the press. This keeps the temperature loading to which the transporting apparatus is subjected to a low level. The means guided on the transporting apparatus are then guided through a through-passage of the furnace, and therefore the components are heated in their entirety in the furnace. The through-passage here runs in the transporting direction, or in the longitudinal direction of the furnace, and is formed, in particular, in a floor or a ceiling of the furnace.

In an alternative configuration, provision is made for the transporting apparatus to be guided within the furnace and/or the press. It is then possible for the furnace to be of gas-tight design and to be operated under a protective atmosphere.

In a preferred development, the means for transporting the components each have at least one accommodating element, on which one of the components can be fastened in a hanging state. In the simplest case here, the accommodating element can be designed in the form of a hook or eyelet and interact with a corresponding eyelet or a corresponding hook of the component. It is also possible, however, for the accommodating element to be configured in an active manner, being designed, for example, in the form of a gripper. In order to realize a plurality of coupling locations between the means and the component, it is also possible to provide a plurality of accommodating elements on one means or for each accommodating element to provide a plurality of coupling locations. This allows the components to be transported in a stable manner. It is always the case that the accommodating element or elements of the means comes or come into contact with the component in a region which is located outside a useful region. Hanging the components on the means here has the advantage that the components are guided in a stable position. In particular, there is then hardly any risk of the components falling over or buckling.

An alternative configuration makes provision for the means for transporting the components each to have at least one accommodating element, on which one of the components can be fastened in a standing state. The accommodating element or the accommodating elements here can be designed, in turn, in the form of hooks, eyelets, grippers or the like, wherein one or more accommodating elements are assigned to any one means in order to provide one or more coupling locations. Depending on the configuration of the components, a conveying operation in a standing state may be more expedient than one in a hanging state. In particular in the case of heavy components, the weight-induced forces are more easily absorbed.

The means for transporting the components preferably have covers, by means of which the components can be covered at least in part. Each means here may have in each case one cover. These covers make it possible for individual regions of the components to be subjected to different temperature controls. Covering a region of the components by means of a cover results in this region usually being subjected to less heat, and thus being heated to a lesser extent, in the furnace. This can be utilized to achieve regions of different levels of ductility or with different degrees of hardness.

A preferred development makes provision for a temperature-control device to be arranged in the furnace and/or between the furnace and the press and/or in the press, and said device can actively control the temperature of individual regions of the components. The temperature-control device may have, for example, infrared lamps, in order to provide additional heating for individual regions of the components. It is also possible for individual regions of the components to be cooled specifically, so that these are pressed at a lower temperature. Active temperature control is always provided for individual regions, or at least one individual region, of a component which can be utilized for strength-adjustment purposes.

The transporting apparatus is advantageously designed in the form of a guide rail, in which the means for transporting the components are guided. This constitutes a relatively straightforward configuration for transporting the means in a guided manner. It is possible here to provide a central drive for all the means; however, it is also conceivable for the means to be provided with dedicated drives.

The object mentioned in the introduction is achieved according to the invention in the case of a method for pressing components using an apparatus according to the invention and by practicing the following steps:

a) the components are fastened on means for transporting the components, said means being mounted in a displaceable manner in a transporting apparatus, and the components are transported, along the transporting apparatus, to a furnace,
b) the components fastened on the means for transporting the components are introduced into the furnace,
c) the components fastened on the means for transporting the components are transported through the furnace, along the transporting apparatus, wherein the components are heated,
d) the components fastened on the means for transporting the components are transported continuously, along the transporting apparatus, to a press, and
e) the components are shaped in the press.

Instead of different manipulators being used to introduce the components first of all into the furnace and then into the press, the components are transported continuously by one transporting apparatus throughout, which is continuous at least from a loading station upstream of the furnace, as seen in the movement direction, into a pressing position in the press. The means here can come into contact with the components exclusively in regions which are located outside a later useful region. Therefore, a coating applied there cannot damage the means, nor can the means adversely affect the coating.

Overall, therefore, it is not just a relatively short cycle time which is achieved; in addition, the variability, in particular in respect of coatings which can be used, is also increased.

BRIEF DESCRIPTION OF THE DRAWINGS

The invention will be described in more detail hereinbelow with reference to preferred exemplary embodiments in conjunction with the drawings, in which, in schematic views.

DETAILED DESCRIPTION OF THE INVENTION

Figure 1:
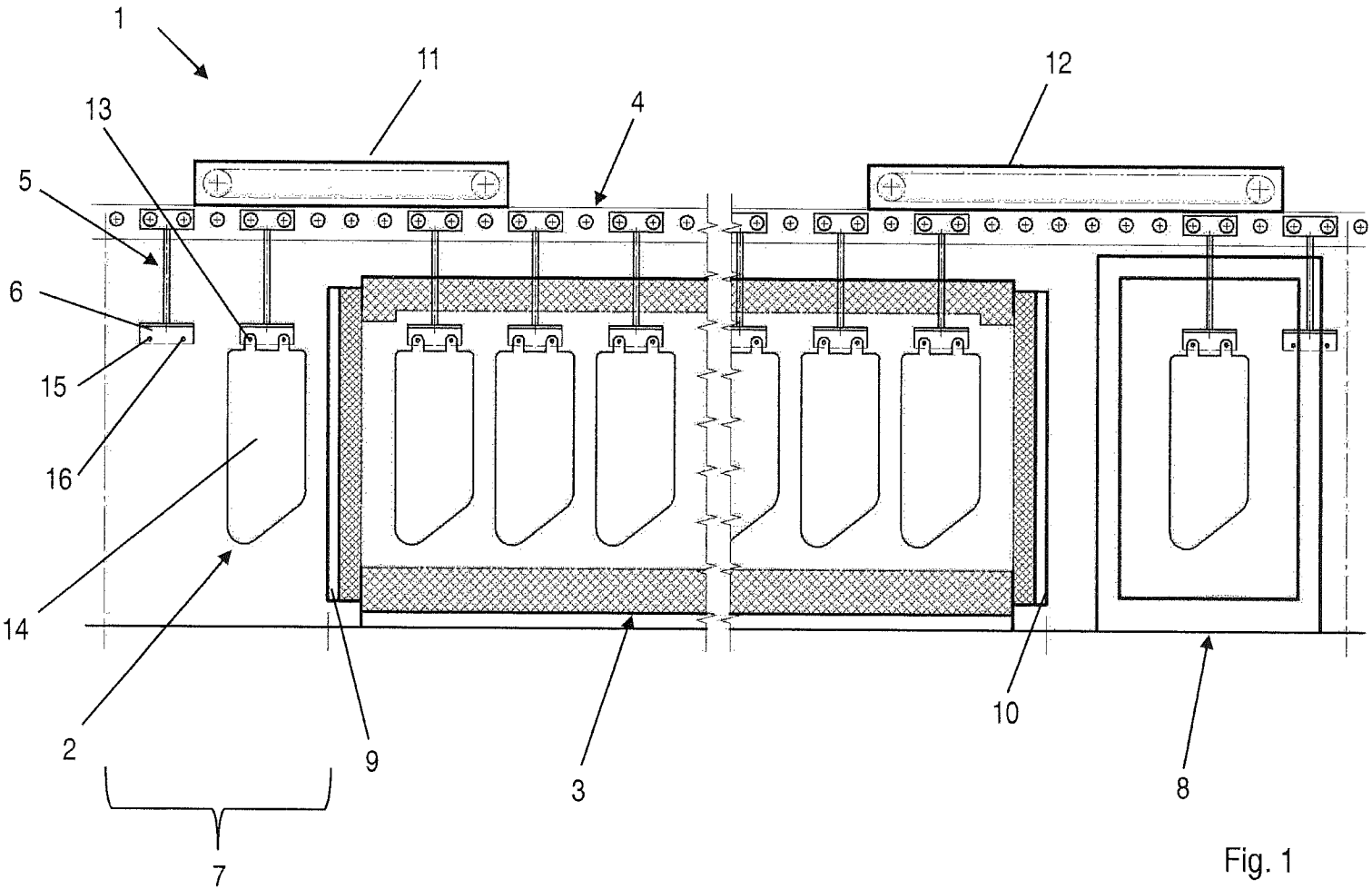
FIG. 1 shows a longitudinal section of an apparatus according to the invention.

FIG. 1 illustrates, in longitudinal section, an apparatus 1 for the press hardening of components 2. The apparatus 1 has a furnace 3, which is designed in the form of a continuous furnace. Running above the furnace 3 is a transporting apparatus 4, which has means 5 on which the components 2 can be fastened in a hanging state via accommodating elements 6.

With the aid of the transporting apparatus 4, the components 2 can be transported from a loading station 7, in which the means 5 are charged with the components, through the furnace 3 and into a pressing position in a press 8, without any further manipulation being necessary at any time. For this purpose, the furnace 3 has, on the entry side, an entry door 9 and, on the exit side, an exit door 10, each designed in the form of sliding doors. The furnace 3 can be closed and opened via the entry door 9 and the exit door 10 in order, in the closed state, to achieve better heat distribution and, in particular, to keep the heat losses to a low level.

The transporting apparatus 4 is designed as a kind of guide rail, in which the means 5 are guided. A first drive mechanism 11 is provided in the region of the loading station 7 and provides for a slowed-down movement of the means 5, and therefore simplifies the charging operation. In the region of an exit of the furnace 3, the transporting apparatus 4 is assigned a second drive mechanism 12, which serves as an express exit and bridges the distance to the press. The means 5 with the components 2 heated in the furnace are thus displaced at relatively high speed from the exit of the furnace into the press 8. The period of time over which the components 2 cool is thus kept to a low level.

The components 2 thus arrive in the press 8 with a very low level of temperature loss and can be deformed directly in said press.

In the case of this exemplary embodiment, the press 8 is designed in the form of a horizontal press, that is to say it has a horizontal pressing direction, and therefore the components 2 oriented in a hanging or vertical state can be pressed directly without having to be rotated or pivoted beforehand. Rather, the components 2 can be moved into the press simply in a state in which they hang on the means 5, without any manipulation being required.

The accommodating elements 6 of the means 5 come into contact with the components 2 in connection regions 13, which are located outside a useful region 14 of the components 2. In particular the connection regions 13, as shown in the exemplary embodiments, are formed as lugs on the useful region 14. A coating present in the useful region 14 thus does not come into contact with the accommodating elements 6 of the means 5, and therefore even relatively aggressive coatings, which could result in the means 5 or the accommodating elements 6 being corroded, can be handled straightforwardly, in that the connection regions 13 may be configured without any coating.

Even the use of contact-sensitive coatings is readily possible, since there is no contact with the means 5 taking place in the useful region 14. Rather, the useful regions 14 are guided contactlessly through the furnace 3 into the press 8.

The components 2 can be released from the means 5, for example, during the pressing operation, by the connection regions 13 being separated off in the press 8. It is also conceivable, however, for the components 2 to be displaced out of the press again via the means 5 and only then to be separated from the means 5.

In the exemplary embodiment shown, the components 2 are retained on the accommodating elements 6 of the means 5 via two coupling locations 15, 16. The coupling locations 15, 16 here are designed in the form of projecting pins, which engage in eyelets formed in the connection regions 13 of the components 2. The components 2 are thus retained in a form-fitting manner, by being pushed onto the pins of the coupling locations 15, 16. It is also readily possible, however, for the accommodating elements 6 to be configured separately. For example, the accommodating elements 6 may also be designed in the form of active grippers, and therefore the shape of the connections regions 13 of the components 2 does not have to meet such specific requirements. If appropriate, it is also possible to dispense with a separate configuration of the connection regions.

Figure 2:
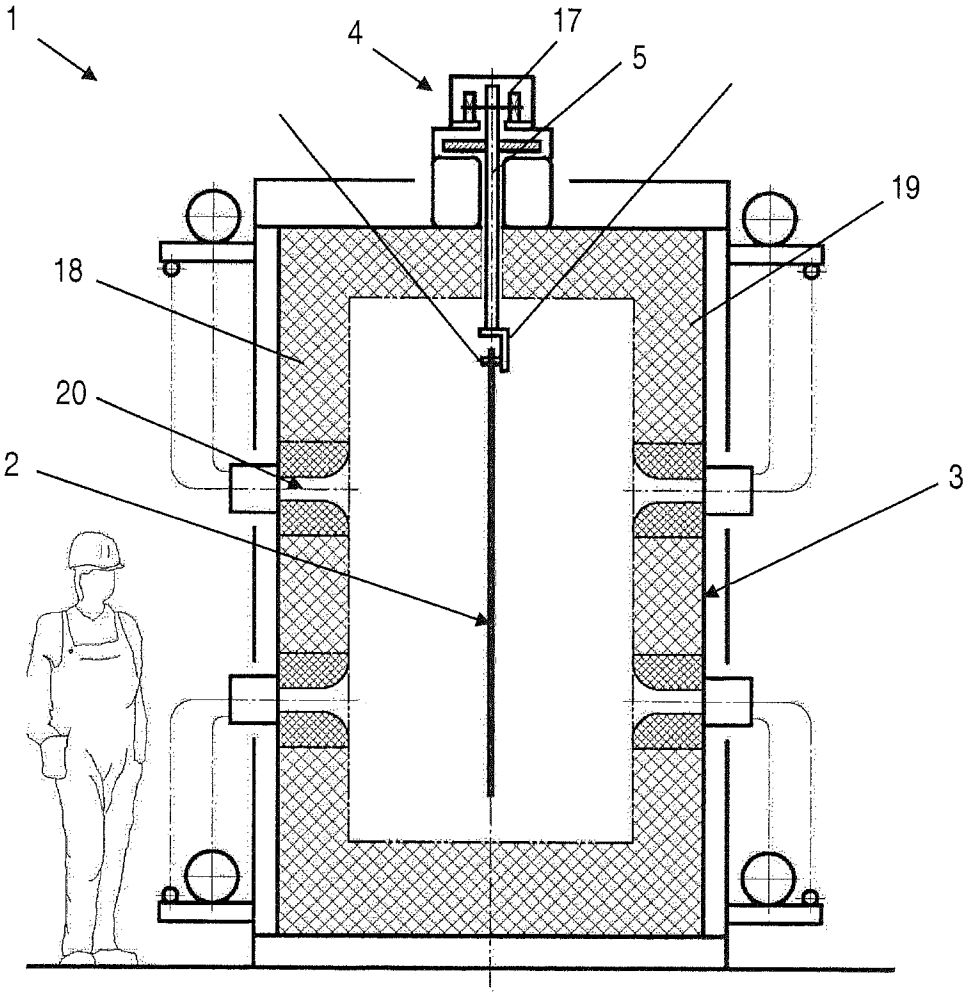
FIG. 2 shows a continuous furnace in cross section.

FIG. 2 illustrates a cross section through the furnace 3 and the transporting apparatus 4. The means 5 are guided in a moveable manner, via wheels 17, in the transporting apparatus 4, which is designed in the form of a guide rail. The components 2 here are fastened in a hanging state on the means 5, and thus on the transporting apparatus 4, via the accommodating elements 6, and the components 2 can therefore be guided through the furnace 3 without there being any contact with the useful region 14 of the components 2.

Gas burners 20, for example, are introduced in side walls 18, 19 of the furnace 3. Optimum temperature distribution in the furnace 3 can be achieved by way of an appropriate number of gas burners 20. The gas burners 20 serve, for example, for introducing heat energy into the furnace. It is possible here for temperatures of up to 1200° C. to be generated in the furnace 3.

It is also possible to subdivide the furnace 3 into different temperature zones, in order to meet different process requirements.

Figure 3:
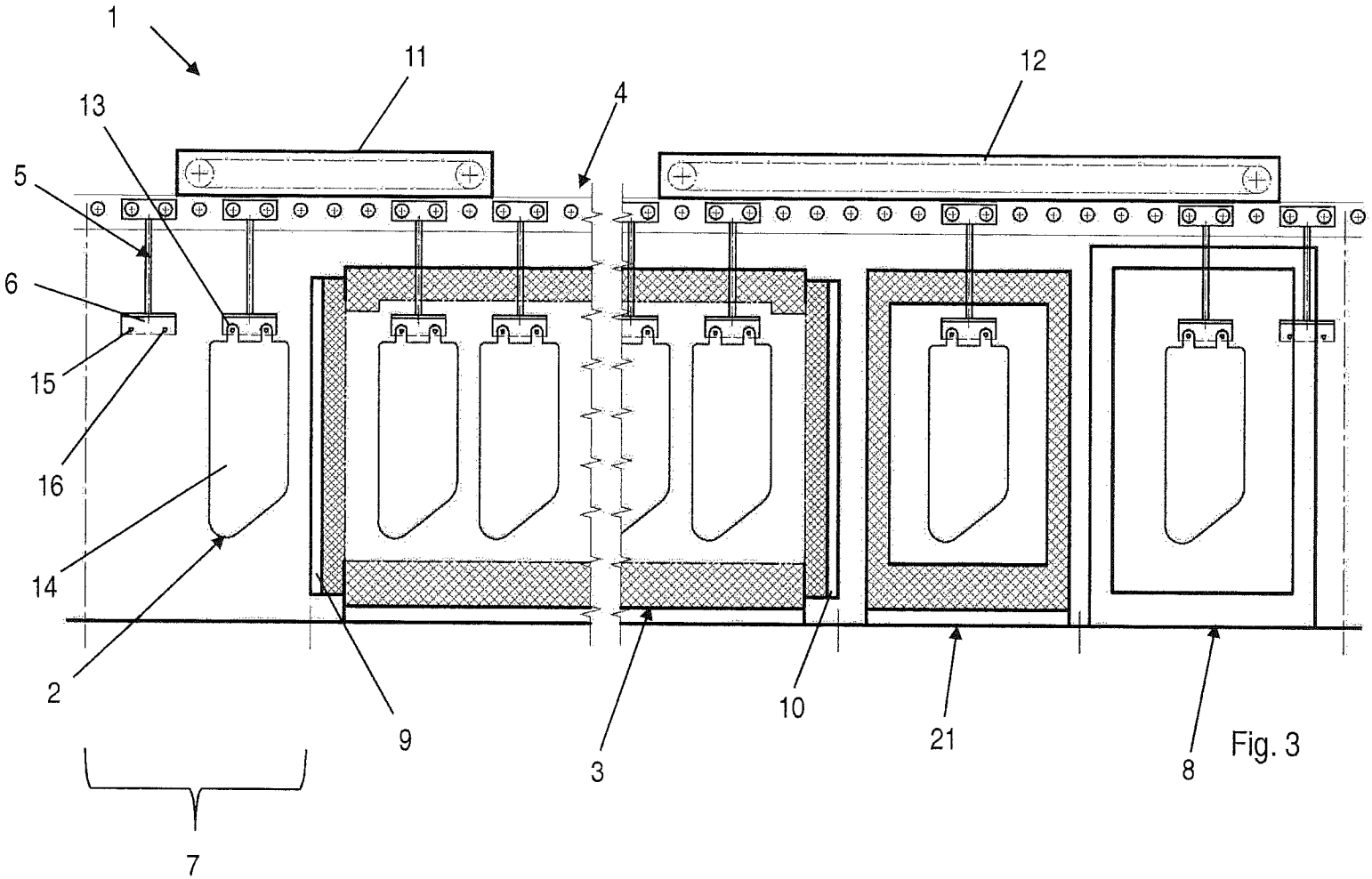
FIG. 3 shows a development of the apparatus according to FIG. 1.

FIG. 3 illustrates the apparatus 1 with an additional temperature-control device 21, which is arranged between the furnace 3 and press 8. Active partial temperature control of the components, that is to say active heating or cooling of sub-regions, can take place in the temperature-control apparatus 21. For heating purposes, the temperature-control device 21 may have, for example, infrared lamps, in order to general local heating of the components 2 via radiant heat. Cooling can be carried out, for example, with the aid of air nozzles formed in the temperature-control device 21.

As an alternative, or in addition, to an active temperature-control device 21, provision may also be made to provide the means 5 with covers, so that certain regions of the components 2 can be covered prior to transportation through the furnace 3, said regions therefore being subjected to a lower level of heating. This makes it possible for individual regions of the components 2 to be kept cooler.

The partial temperature differences make it possible to influence ductility or a degree of hardness or strength adjustment in individual regions of the finished components.

Rather than being limited to the exemplary embodiments shown, the invention can be modified in various ways. Instead of the furnace being designed with a transporting apparatus which is arranged above the furnace and on which the components are guided in a hanging state, it is also conceivable to have a configuration in which the components are transported in a standing state on the means. It is also possible for the components, which in the exemplary embodiment are designed in the form of straightforward metal sheets, to be in more complicated forms and be designed, for example, in the form of profiles or tubes or to be formed by a combination of a plurality of elements, which are, for example, welded to one another.

The apparatus according to the invention can be used for the heat treatment, and deformation, of coated components, in particular coated metal sheets, controlled cooling possibly taking place at the same time without the transporting apparatus being affected in thermochemical terms by the coating or without any risk of the coating being damaged by contact with the transporting apparatus. Dispensing with additional manipulators, by virtue of the transporting apparatus transporting the components continuously from a loading station, through the furnace, to the press, considerably reduces cycle times, in particular the time taken from the exit from the furnace to the start of the pressing operation. It is thus the case here that the same means are used to introduce the components into the furnace, guide them through the furnace and transport them into the press.

All the features and advantages, including design details, spatial arrangements and method steps, which can be gathered from the claims, the description and the drawing may be essential to the invention both in themselves and in a wide variety of different combinations.

List of Designations

| | |
|---|---|
| 1 | Apparatus |
| 2 | Components |
| 3 | Furnace |
| 4 | Transporting apparatus |
| 5 | Means |
| 6 | Accommodating elements |
| 7 | Loading station |
| 8 | Press |
| 9 | Entry door |
| 10 | Exit door |
| 11 | Drive mechanism |
| 12 | Drive mechanism |
| 13 | Connection region |
| 14 | Useful region |
| 15 | Coupling location |
| 16 | Coupling location |
| 17 | Wheels |
| 18 | Side wall |
| 19 | Side wall |
| 20 | Gas burners |
| 21 | Temperature-control device |

The invention claimed is:

1. An apparatus for the press hardening of components (2):

having at least one furnace (3), having a press (8), which is arranged downstream of the at least one furnace (3), and having a transporting apparatus (4), characterized in that means (5) for transporting the components (2) are mounted in a moveable manner in the transporting apparatus (4), wherein the means (5) with the components (2) can be moved, along the transporting apparatus (4), through the furnace (3) and into the press (8), and wherein the transporting apparatus (4) is continuous from a loading station (7) upstream of the furnace (3), as seen in the movement direction, at least into a pressing position in the press (8), wherein the components (2) can be transported from the furnace (3) to the press (8) without being manipulated and the transporting apparatus (4) is designed in the form of a guide rail, in which the means (5) for transporting the components (2) are guided, wherein a first drive mechanism (11) is provided in a region of the loading station (7) and provides for a slowed-down movement of the means (5), and wherein in the region of an exit of the furnace (3), the transporting apparatus (4) is assigned a second drive mechanism (12), which serves as an express exit and bridges a distance to the press, such that the means (5) with the components (2) heated in the furnace (3) are displaced at relatively high speed from the exit of the furnace (3) into the press (8).

2. The apparatus as claimed in claim 1, characterized in that the furnace (3) is designed in the form of a continuous furnace.

3. The apparatus as claimed in claim 1, characterized in that the press (8) is designed in the form of a press with a horizontal pressing direction.

4. The apparatus as claimed in claim 1, characterized in that the transporting apparatus (4) is guided outside the furnace (3) and/or the press (8).

5. The apparatus as claimed in claim 1, characterized in that the transporting apparatus (4) is guided within the furnace (3) and/or the press (8).

6. The apparatus as claimed in claim 1, characterized in that the means (5) for transporting the components (2) have accommodating elements (6), on which the components (2) can be fastened in a hanging state.

7. The apparatus as claimed in claim 1, characterized in that the means (5) for transporting the components (2) have accommodating elements (6), on which the components (2) can be fastened in a standing state.

8. The apparatus as claimed in claim 1, characterized in that the means (5) for transporting the components (2) have covers, by means of which the components (2) can be covered at least in part.

9. The apparatus as claimed in claim 1, characterized in that a temperature-control device (21) is arranged in the furnace (3) and/or between the furnace (3) and the press (8) and/or in the press (8), and said device can actively control the temperature of individual regions of the components (2).

10. A method for the press hardening of components using an apparatus as claimed in claim 1, comprising the following steps:

a) the components (2) are fastened on means (5) for transporting the components (2), said means being mounted in a displaceable manner in a transporting apparatus (4), and the components (2) are transported, along the transporting apparatus (4), to a furnace (3), b) the components (2) fastened on the means (5) for transporting the components are introduced into the furnace (3), c) the components (2) fastened on the means (5) for transporting the components are transported through the furnace (3), along the transporting apparatus (4), wherein the components (2) are heated, d) the components (2) fastened on the means (5) for transporting the components are transported continuously, along the transporting apparatus (4), to a press (8), e) the components (2) are shaped in the press (8).

11. The method as claimed in claim 10, wherein in step (d), the components are not manipulated as the components are transported from the furnace (3) to the press (8).

* * * * *